US011236571B2

(12) United States Patent
Kleppa

(10) Patent No.: US 11,236,571 B2
(45) Date of Patent: Feb. 1, 2022

(54) WELLHEAD ASSEMBLY AND METHOD

(71) Applicant: PETROLEUM TECHNOLOGY COMPANY AS, Stavanger (NO)

(72) Inventor: Erling Kleppa, Jørpeland (NO)

(73) Assignee: Petroleum Technology Company AS, Stavanger (NO)

( * ) Notice: Subject to any disclaimer, the term of this patent is extended or adjusted under 35 U.S.C. 154(b) by 0 days.

(21) Appl. No.: 16/489,911

(22) PCT Filed: Feb. 27, 2018

(86) PCT No.: PCT/NO2018/050051
§ 371 (c)(1),
(2) Date: Aug. 29, 2019

(87) PCT Pub. No.: WO2018/160070
PCT Pub. Date: Sep. 7, 2018

(65) Prior Publication Data

US 2020/0040687 A1 Feb. 6, 2020

(30) Foreign Application Priority Data

Mar. 1, 2017 (NO) ..... 20170297

(51) Int. Cl.
*E21B 33/04* (2006.01)
*E21B 34/02* (2006.01)
(Continued)

(52) U.S. Cl.
CPC ..... *E21B 33/04* (2013.01); *E21B 23/00* (2013.01); *E21B 34/02* (2013.01); *E21B 33/03* (2013.01); *E21B 33/068* (2013.01)

(58) Field of Classification Search
CPC ..... E21B 33/04; E21B 23/00; E21B 34/02; E21B 33/03; E21B 33/068
See application file for complete search history.

(56) References Cited

U.S. PATENT DOCUMENTS 4,597,067 A * 6/1986 Bockhorst ..... E21B 47/16 367/82
7,504,963 B2 * 3/2009 Hall ..... E21B 17/003 340/854.8
(Continued)

FOREIGN PATENT DOCUMENTS

CA 2461402 A1 9/2005
WO 200157360 A1 8/2001
(Continued)

OTHER PUBLICATIONS

PCT International Search Report; PCT/NO2018/050051; dated May 18, 2018.
Norwegian Search Report; NO 20170297; dated Sep. 29, 2017.

*Primary Examiner* — Cathleen R Hutchins
*Assistant Examiner* — Jonathan Malikasim
(74) *Attorney, Agent, or Firm* — K&L Gates LLP

(57) ABSTRACT

A wellhead port plug assembly having a sensor unit, a plug, a transmitter unit arranged in the sensor unit and comprising a wireless signal transmitter, and a receiver unit arranged on the spool unit and comprising a wireless signal receiver. There is also disclosed a method for installing, removing or replacing a sensor unit located in a port of a wellhead.

28 Claims, 10 Drawing Sheets

(51) Int. Cl.

| | |
|---|---|
| ***E21B 23/00*** | (2006.01) |
| ***E21B 33/068*** | (2006.01) |
| ***E21B 33/03*** | (2006.01) |

(56) References Cited

U.S. PATENT DOCUMENTS

| | | | | |
|---|---|---|---|---|
| 9,217,322 | B2 * | 12/2015 | Kleppa | E21B 33/0355 |
| 10,012,327 | B2 * | 7/2018 | Bohaychuk | F16K 37/005 |
| 2013/0269945 | A1 | 10/2013 | Mulholland et al. | |
| 2016/0069178 | A1 | 3/2016 | Mulholland et al. | |
| 2017/0030160 | A1 | 2/2017 | Gray | |
| 2017/0044861 | A1 | 2/2017 | Guedes et al. | |

FOREIGN PATENT DOCUMENTS

| | | | |
|---|---|---|---|
| WO | 2003/016673 | A1 | 2/2003 |
| WO | 2006061645 | A1 | 6/2006 |
| WO | 2011093717 | A2 | 8/2011 |
| WO | 2013/056857 | A1 | 4/2013 |
| WO | 2015/162241 | A1 | 10/2015 |

* cited by examiner

WELLHEAD ASSEMBLY AND METHOD

BACKGROUND

Field of the Disclosure

The present disclosure relates to a wellhead port plug assembly for use in a port of a wellhead of a hydrocarbon well, i.e. an oil and/or gas well.

Description of the Related Art

It is common to provide a wellhead of a hydrocarbon well with ports allowing the mounting of devices for monitoring the annuli of the well. It is crucial that such devices, when mounted in a wellhead port, provide a secure seal between the annulus and the atmosphere, in order to prevent leakage of the generally high-pressure hydrocarbon fluids. When not utilised for monitoring and measuring purposes, such ports must also be blocked in order to prevent leakage. This is normally done by positioning a blind plug in the port such that the port is blocked. A blind plug is basically a plug body having no other purpose than to provide a sealing or plugging function. In all cases, double barriers are usually required.

A problem related to plug bodies positioned in wellhead ports of a hydrocarbon producing well, is that the well need normally to be taken out of production if the plug body is to be replaced. For example, a plug body may occasionally leak, in which case the plug body may need to be substituted for a new plug body, or sensors or sensor electronics arranged in such plug bodies may fail or need replacement for other reasons. Also, it may be desirable to install a monitoring or measuring system in a previously unused port without modification to the wellhead, in which case a blind plug needs to be removed and a plug body comprising a sensor needs to be positioned in its place. During such removal, installation or replacement, it may also be necessary to pressure test all seals and barriers upon installation, and in some cases also regularly during production from the well, in order to ensure the integrity of the barriers.

Prior art which may be useful for understanding the background includes WO 2013/056857, WO 2001/57360, WO 2006/061645, and WO 2011/093717.

With the serious consequences that may result from a potential leakage of hydrocarbon fluids, there is a continuous need for improved systems and methods for measuring and monitoring well operational parameters (such as annulus pressures). The present disclosure has the objective to provide a wellhead port plug assembly and associated method which provides advantages over known solutions and techniques with regards to the above mentioned or other aspects.

SUMMARY

Embodiments of the present disclosure relate to a wellhead port plug assembly comprising a sensor unit with connection elements allowing the sensor unit to be sealingly and removably mounted in a port of a wellhead of a petroleum well. Embodiments also relates to a wellhead of a petroleum well comprising such a sensor unit and to a method of installing, removing or replacing the sensor unit.

Embodiments also relate to methods for removing, replacing or installing a sensor unit in a port of a wellhead, and to methods for operating a wellhead having a port plug assembly.

Further embodiments are set out and specified in the appended claims.

BRIEF DESCRIPTION OF THE DRAWINGS

Illustrative embodiments of the present disclosure will now be described with reference to the appended drawings, in which.

DETAILED DESCRIPTION

Figure 1:
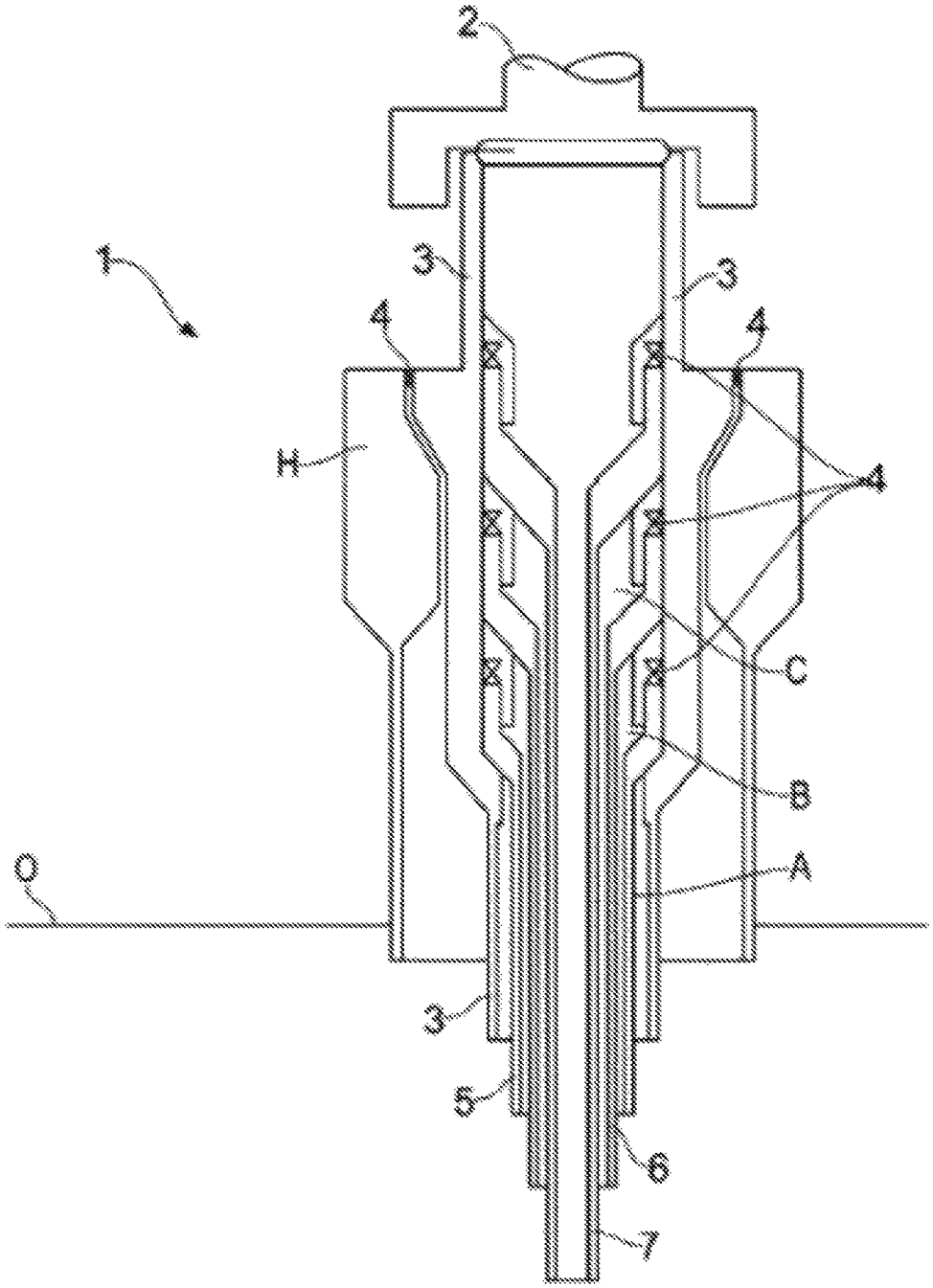
FIG. 1 illustrates a wellhead structure of a petroleum well.

FIG. 1 schematically discloses a typical wellhead structure that is used in connection with a hydrocarbon well. The wellhead structure comprises a wellhead 1 which is positioned on a base formation O. The wellhead 1 comprises a housing H and a first casing 3, a second casing 5, a third casing 6 and a fourth casing 7 which extend coaxially a distance down into the base formation O such that a first annular space A, or annulus, is formed between the first casing 3 and the second casing 5, a second annulus B is formed between the second casing 5 and the third casing 6, and a third annulus is formed C between the fourth casing 7 and the third casing 6. Sealing devices 4, in the form of packers, are arranged between the housing H and the casings 3, 5, 6, 7 such that pressure tight connections between the housing H and the casings 3, 5, 6, 7 are obtained. When the hydrocarbon well is in production, a production tubing (not shown) will be arranged inside the fourth casing 7.

Ports or channels are arranged in the wellhead 1 to allow access from outside the wellhead 1 to one or more of the annuli A, B, C, for injection of fluids into an annulus, for example for gas lift purposes, or in order to bleed off fluids from the annulus, for example in the case of a pressure build-up in the annulus. Valves will typically be installed in the ports or channels in the wellhead structure for this purpose. Such valves may be arranged to be actively be opened by applying hydraulic pressure or actively closed by an elastic element, when no hydraulic force is present. In the closed position the valve will act as a fail safe closed barrier, even if e.g. hydraulic supply lines should be damaged.

Figure 2:
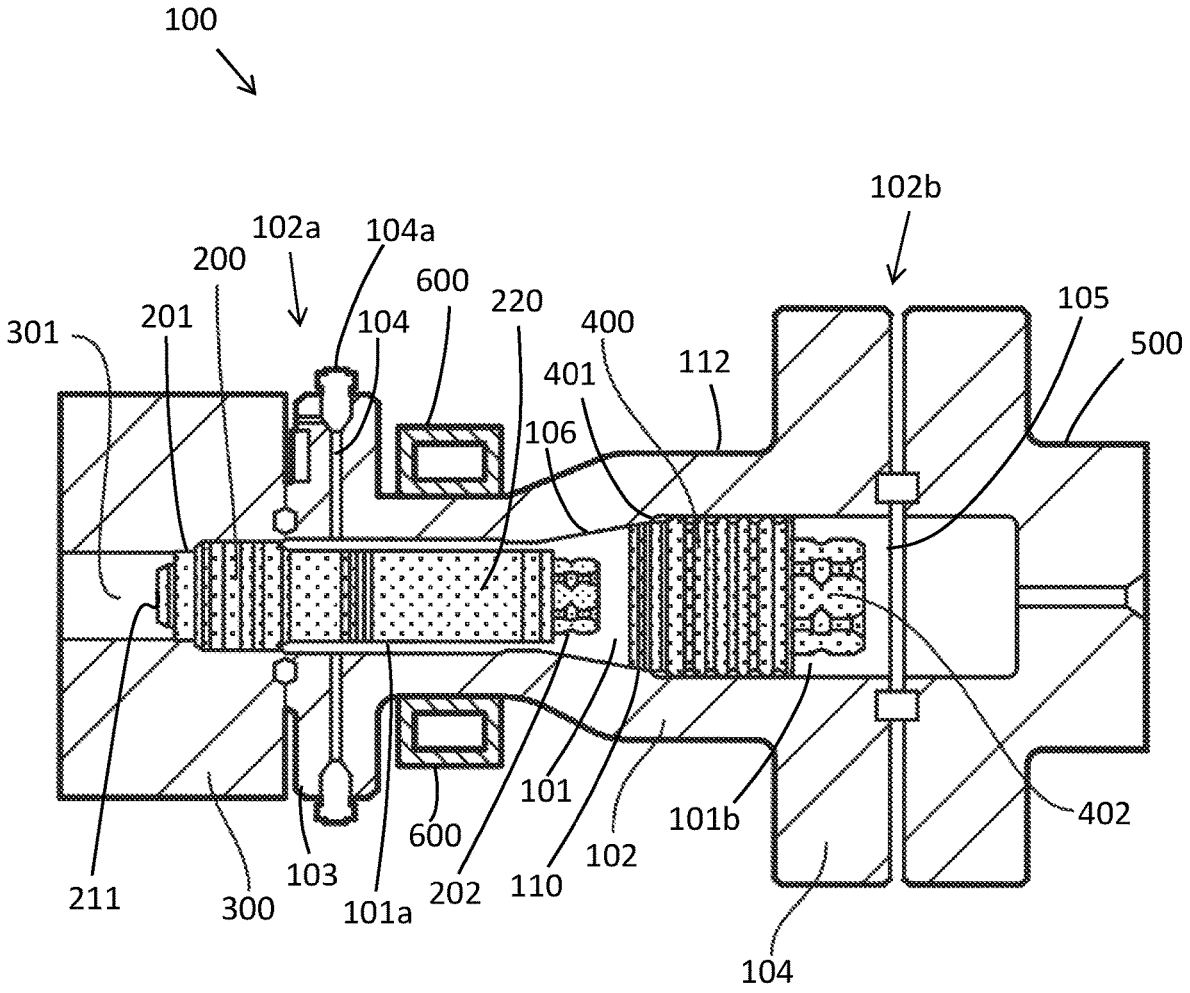
FIG. 2 illustrates a plug assembly according to an embodiment.

FIG. 2 shows a plug assembly 100 with a spool unit 102 with a through-channel 101 extending between a first end 102*a* and a second end 102*b* of the spool unit 102, and a flange 103 arranged in conjunction with the first end 102*a*. The first flange 103 is configured for sealingly mounting the spool unit 102 to the wellhead 300, aligning the through-channel 101 with a port 301 of the wellhead 300. A second flange 104 is arranged in conjunction with the second end 102*b*.

A sensor unit 200 having a generally cylindrical form and comprises at least one sensor 211 for measuring a physical parameter related to a fluid in the port 301 is arranged in the port 301. Such sensors 211 are known as such and will not be discussed further here. As is known in the art, the parameters may comprise, for example, temperature and/or pressure. The sensor unit 200 comprises external threads 201 for cooperation with corresponding internal threads of the channel 301. The sensor unit 200 is threaded into the channel 301 and may be arranged to abut a shoulder in the channel 301 such that a fluid-tight metal-to-metal connection or seal is formed between the sensor unit 200 and the inside wall of the channel 301. The sensor unit 200 thus forms a fluid-tight plug arranged in the channel 301.

The sensor unit 200 comprises a wireless transmission unit 220. The sensor unit 200 may extend into the through-channel 101 such that the wireless transmission unit 220 is positioned fully within the through-channel 101. This may improve wireless transmission quality. Alternatively, the sensor unit 200 can be designed such that the wireless transmission unit 220 is positioned partly in the channel 301 and partly in the through-channel 101, or fully within the channel 301.

A wireless receiver unit 600 is arranged on an outer wall of the spool unit 102. In this embodiment the wireless receiver unit 600 is generally annular in its form and arranged around a section of the spool unit 102.

Figure 3:
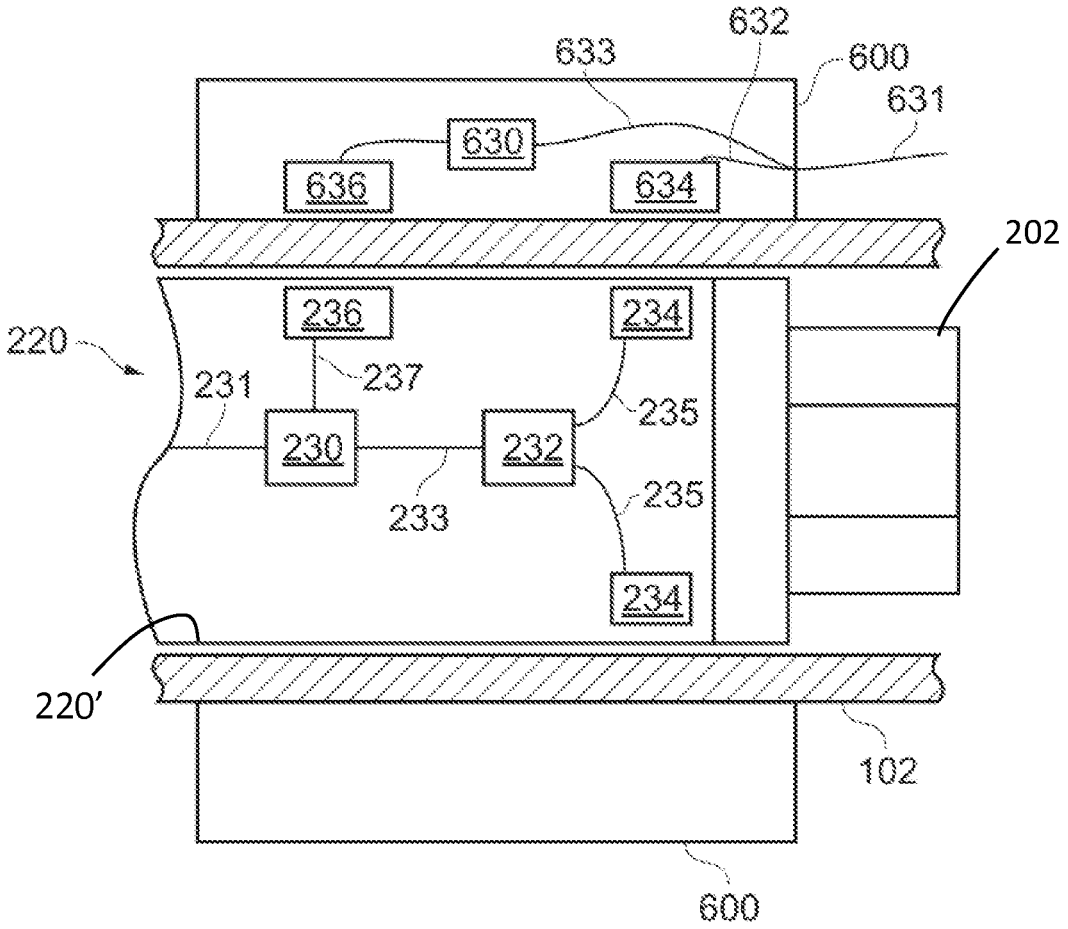
FIG. 3 illustrates parts of a plug assembly according to an embodiment.

The wireless transmission unit 220 and the wireless receiver unit 600 are illustrated in further detail in FIG. 3. The wireless transmission unit 220 comprises a controller unit 230 which is connected to the sensor 211 via a cable 231. The controller unit 230 may, for example, be a programmable microcontroller. The controller unit 230 thus receives the sensor signal via the cable 231. The controller unit 230 receives electric power for its operation from a power unit 232 via cable 233. The power unit 232 is connected to inductive coils 234 via cable 235. The inductive coils 234 can be energised from an external source so as to generate electric power for the power unit 232. The power unit 232 may, additionally or alternatively, comprise a battery for operating the controller unit 230.

The controller 230 is connected to a wireless signal transmitter 236 via cable 237. The sensor unit 200 is thereby able to transmit a wireless signal of the sensor reading, for example a signal indicative of the measured pressure in the channel 301.

The wireless transmission unit 220 has a protective housing 220' in which the abovementioned components are arranged. The housing 220' is a sealed enclosure which may, optionally, be made pressure resistant such that the components of the wireless transmission unit 220 are not damaged or otherwise negatively effected by pressure variations in the through-channel 101.

The wireless receiver unit 600 comprises a receiver 636 configured to receive the wireless signal from the transmitter 236. A signal processor 630 is connected to the receiver 636 and further connected to a transmission line 631 through which the signal can be transmitted from the receiver unit 600 and to, for example, an oilfield control centre or a data storage. The receiver unit 600 further comprises a coil unit 634 which is configured to energise the inductive coils 234 in the sensor unit 200. The coil unit 634 is connected to a power line 632 via the transmission line 631.

Alternatively, the wireless receiver unit 600 may be a stand-alone unit in which data is stored and can be retrieved manually and/or periodically from a data storage incorporated in the receiver unit 600. The wireless receiver unit may be battery-powered.

Referring again to FIG. 2, second connection elements 110, in this embodiment threads, are arranged in the through-channel 101. A plug 400 comprising third connection elements 401, in this embodiment threads, is configured for sealingly and removably engaging the second connection elements 110 such as to mount the plug 400 in the through-channel 101. The plug 400 is arranged in a second through-channel portion 101*b* which is configured to accommodate the plug 400. The plug 400 thereby blocks the through-channel 101 and prevents fluid flow therethrough. By means of the sensor unit 200 and the plug 400, a double barrier between the hydrocarbon well and the outside of the plug assembly 100 is obtained. The plug 400 has a tool engagement element 402 for co-operation with a placement and removal tool 758, described in further detail below.

An annular shoulder 106 is arranged between the first through-channel portion 101*a* and the second through-channel portion 101*b*. The annular shoulder 106 may be arranged to co-operate with the plug 400 for providing a metal-to-metal seal between the spool unit 102 and the plug 400. This ensures a secure and reliable seal between the spool unit 102 and the plug 400.

The second through-channel portion 101*b* has the same or a larger cross-sectional area, i.e. bore, than the first through-channel portion 101*a*, such as to allow the sensor unit 200 to pass through the second through-channel portion 101*b*. The smaller cross-sectional area of the first through-channel portion 101*a* may also provide advantages in terms if signal transmittance and communication between the sensor unit 200 and the receiver unit 600, in that also the outer diameter of the spool unit 102 in this area may be made smaller, as can be seen in FIG. 2.

A blind flange 500, such as a dust cap, is removably mounted to the second end 102*b* such as to cover the end opening 105 of the through-channel 101. This protects the through-channel 101 and the tool engagement element 402 of the plug 400 from e.g. dust, debris, or contaminations from the surroundings.

The flange 103 has a conduit 104 extending from an outer side wall 112 of the plug assembly 100 and into the through-channel 101. The first conduit 104 can be used as a test port, to pressure test the sealings when the sensor unit 200 and the plug 400 are installed. A connector 104*a* is arranged on the outer side wall 112 in conjunction with the first conduit 104 to allow e.g. a pressure test line to be connected.

In one embodiment, a method of operating a plug assembly will now be described with reference to FIGS. 4-9. The method can be used for removing, replacing and/or installing a sensor unit 200 in a port 301 of a wellhead 300 having a plug assembly 100 mounted thereon, as shown in FIG. 2.

Figure 4:
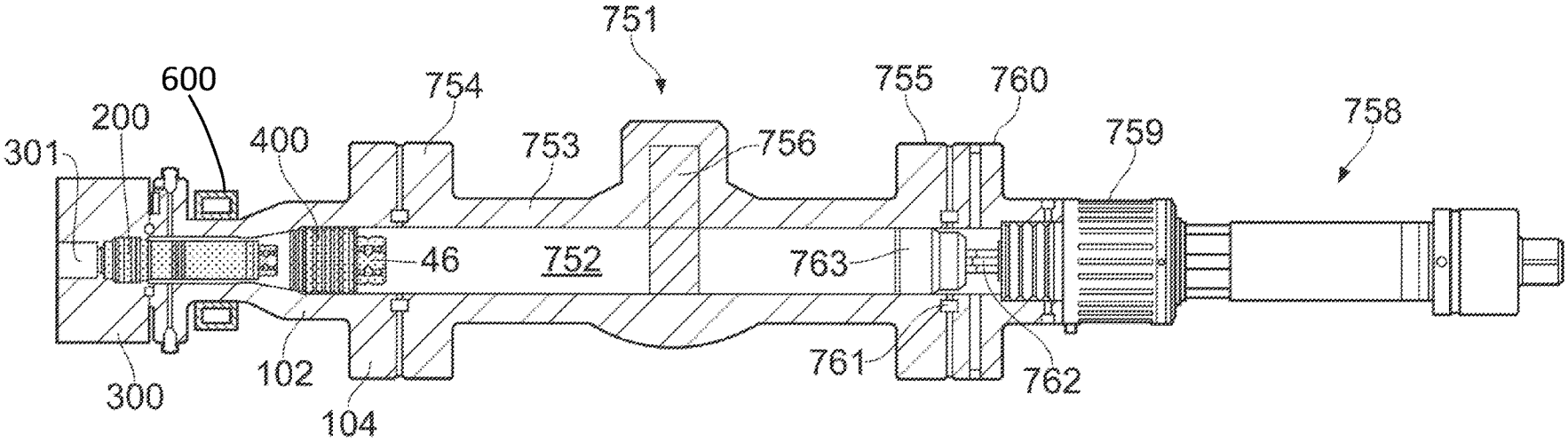
FIGS. 4-9 illustrate steps of a method according to an embodiment.

In a first step, the blind flange 500 is removed. In the next step, a valve unit 751 is mounted to the second end 102*b*, as shown in FIG. 4. The valve unit 751 has a throughbore or channel 752 within an elongated housing 753. At one end, the housing 753 has a first flange 754 and at the other end the housing 753 has a second flange 755. Inside the housing 753, the valve unit 751 has a valve body 756, such as a gate valve, which is operable between a first, closed position in which the valve body 756 blocks the channel 752 providing a fluid-tight seal therein, and a second, open position in which the valve body 756 is retracted in the housing 753 such that it does not restrict the channel 752. The channel 752 generally has substantially the same diameter as the opening 105 of the spool unit 102, and the first flange 754 of the valve unit 751 is connected to the second flange 104 of the spool unit 102 in sealing relationship and such that the through-channel 101 and the channel 752 are arranged coaxially.

The next step comprises attaching a placement and removal tool 758 to the valve unit 751, as is also shown in FIG. 4. The tool 758 may, for example, be of the type disclosed in WO 2011/093717. The tool 758 has a housing 759 which has a flange section 760 allowing the tool 758 to be attached to the second flange 755 of the valve unit 751 and aligned with the channel 752. An annular sealing element 761 is positioned between the flanges 755 and 760 to ensure that a fluid-tight connection is formed between the valve 751 and the tool 758. The tool 758 comprises an extendable and rotatable arm 762 which, in the disclosed embodiment, comprises a first, outer arm section 762*a* and a second, inner arm section 762*b* which is telescopically movable within the outer arm section 762*a* (see FIG. 5). At the end of the arm 762, there is attached an interchangeable engagement element 763 which is compatible with one or both of the tool engagement elements 202, 402 of the sensor unit 200 and the plug 400, respectively.

The valve unit 751 and the placement and removal tool 758 can be mounted onto the spool unit 102 sequentially, i.e. first mounting the valve unit 751 to the spool unit 102 and then the tool 758 to the valve unit 751, or these may be pre-connected and mounted onto the spool unit 102 in the same operation.

After mounting the placement and removal tool 758 and the valve unit 751, the connections are pressure-tested by applying a pressure to the channel 752. Appropriate conduits (e.g. conduit 765; see FIG. 6) are provided to allow, for example, pressurised gas to be supplied to the channel 752. The pressure testing may be carried out with the valve body 756 in the closed position to pressure test only the connection between flanges 104 and 754 or 755 and 760, or with the valve body 756 in the open position in order to test the connections at both these.

Figure 5:
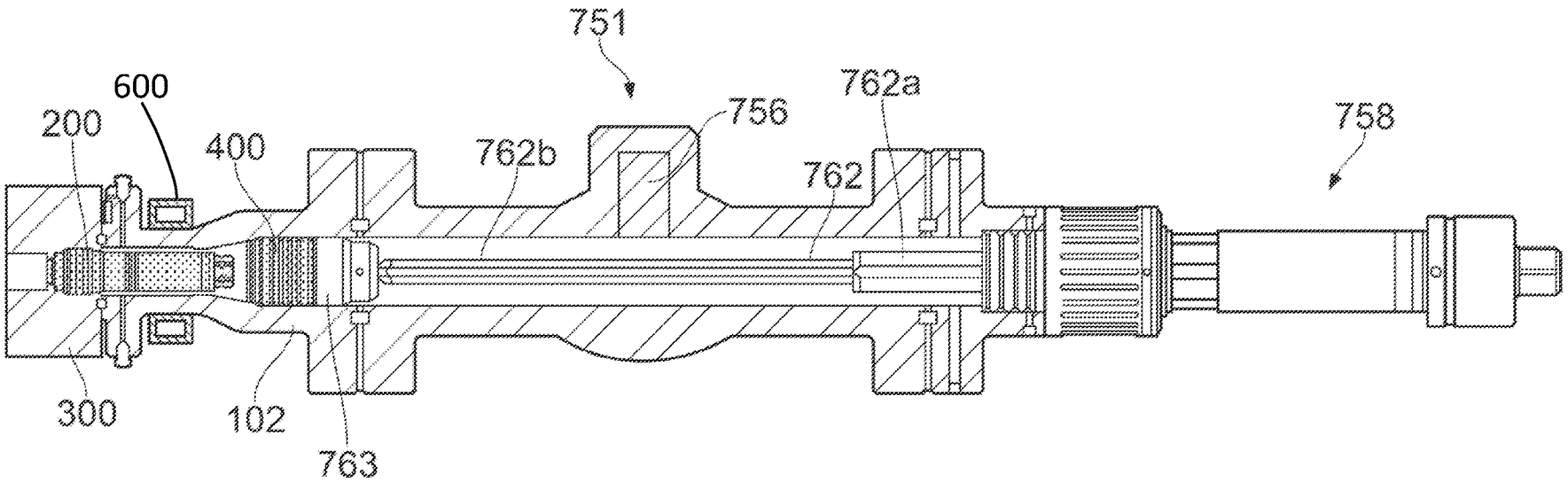

In the next step, the valve body 756, if originally provided in the closed position, is opened, as shown in FIG. 5. The arm 762 is extended such that the engagement element 763 is brought into contact with and connects to the tool engagement element 402 of the plug 400, as shown in FIG. 5. Thereafter, the arm 762 is brought to rotate such that the threaded engagement between the external threads 401 of the plug 400 and the internal threads 110 of the through-channel 101 is disengaged.

Figure 6:
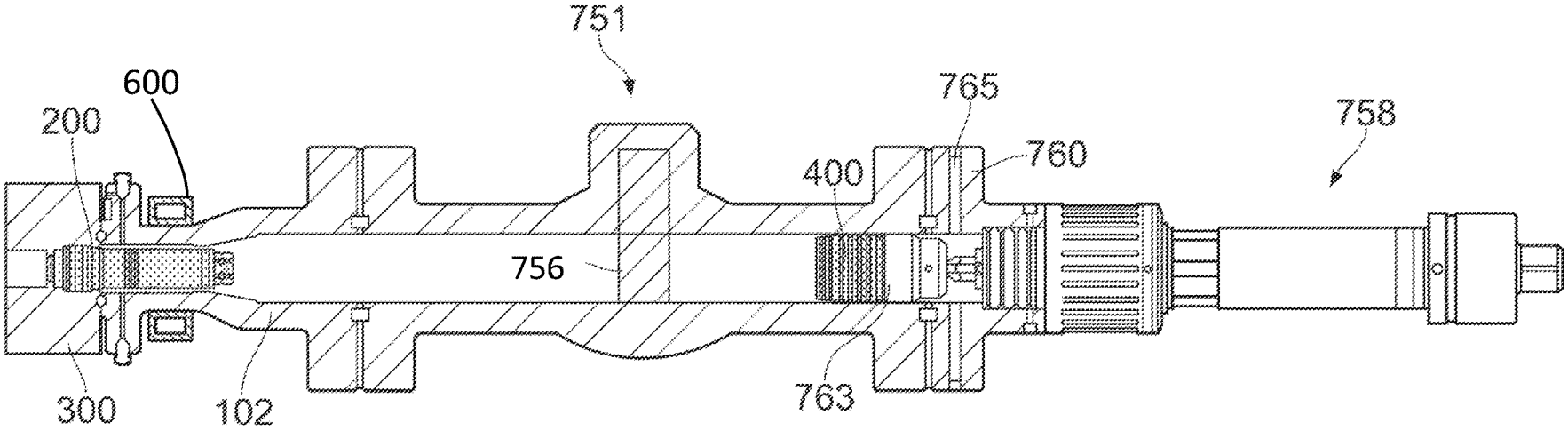

Thereafter, the arm 762 and the now detached plug 400 are retracted out of the spool unit 102 and into the valve unit 751 past the valve body 756, whereafter the valve body 756 is brought to its closed position. This situation is illustrated in FIG. 6.

The next step comprises detaching the tool 758 from the valve unit 751 and removing the plug 400 from the engagement element 763. Prior to detaching the tool 758 from the valve unit 751, the tool 758 may be vented via through-bores or channels 765 in the flange 760 of the tool 758. The engagement element 763 is substituted for a different engagement element 764 (see FIG. 7) which is compatible with the sensor unit 200 and its tool engagement element 202. Alternatively, the same plug engagement element may be used if the tool engagement element 202 of the sensor unit 200 is similar in design to the tool engagement element 402 of the plug 400, and/or if the engagement element 763 is compatible with both tool engagement elements 202 and 402.

Figure 7:
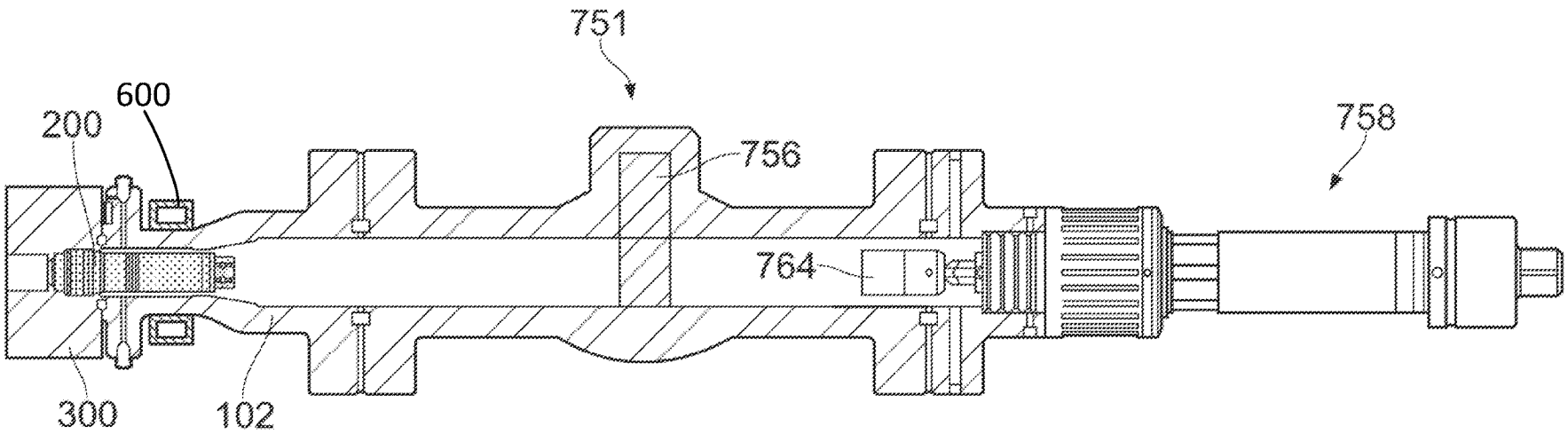
Figure 8:
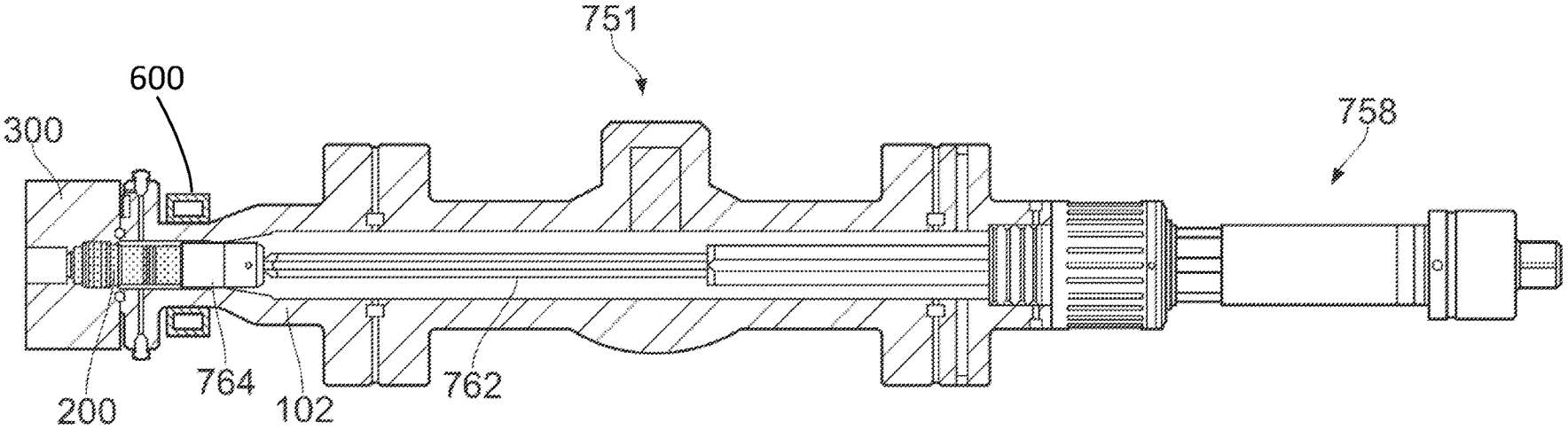

The tool 758 is then reattached to the valve unit 751, as is shown in FIG. 7. Next, the valve unit 751 is once again opened by bringing the valve body 756 to the open position and the arm 762 is extended through the valve unit 751 and into the spool unit 102 such that the engagement element 764 is brought into contact with and connects to the tool engagement element 202 of the sensor unit 200, as shown in FIG. 8. Thereafter, the arm 762 is brought to rotate such that the threaded engagement between the sensor unit 200 and the port 301 is disengaged.

Alternatively, the tool 758 may be arranged with an internal handling mechanism to remove the plug 400 from the engagement element 763 while the tool 758 is connected to the plug port assembly 100, so that detaching and re-attaching the tool 758 between the removal of the plug 400 and the removal of the sensor unit 200 is not necessary. For example, the tool 758 may have a clamp and a container, whereby after retracting the arm 762 the clamp engages the plug 400, the engagement element 763 releases the plug 400, and the plug 400 is allowed to drop into the container, whereby the arm 762 is immediately ready to carry out the step for removing the sensor unit 200.

Figure 9:
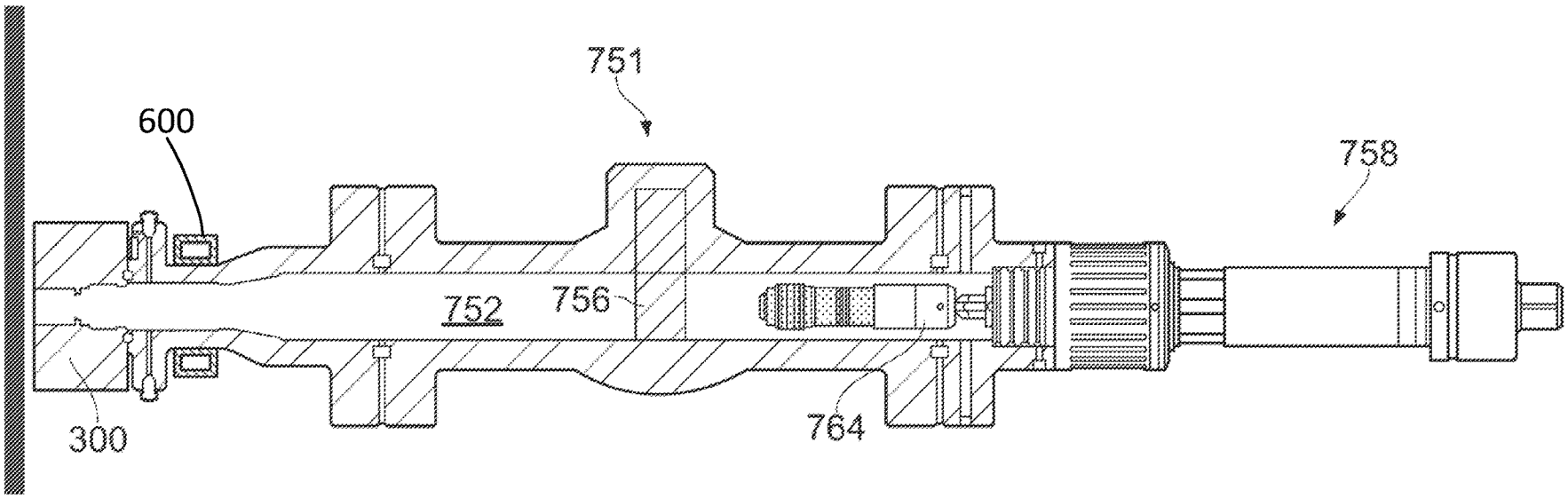
Figure 10:
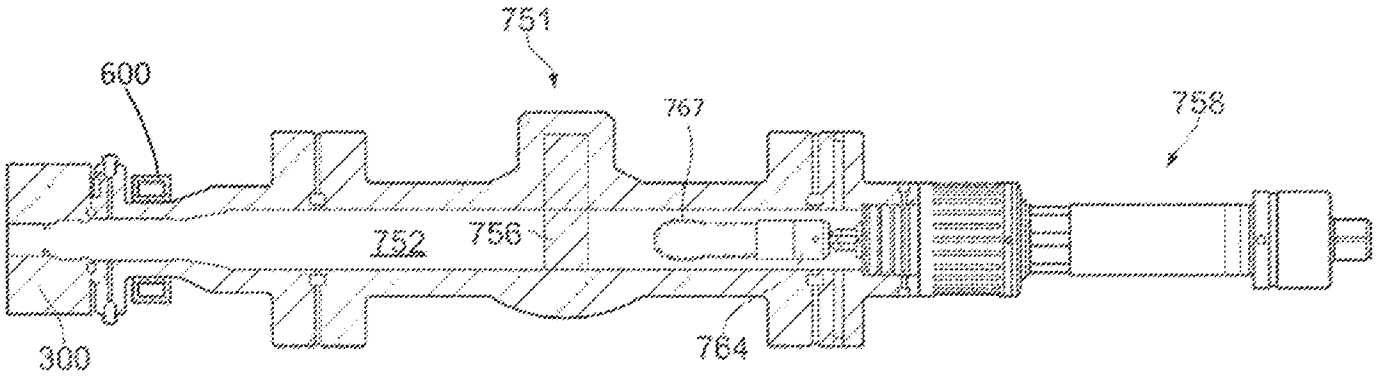
FIG. 10 illustrates a plug assembly with a dummy plug according to an embodiment.

After disengaging the sensor unit 200, the arm 762 and the now detached sensor unit 200 are retracted out of the spool unit 102 as is shown in FIG. 9, whereafter the valve body 756 is brought to its closed position. Next, the tool 758 is detached from the valve unit 751 and the sensor unit 200 to be removed or replaced is disconnected from the engagement element 764.

The sensor unit 200 has now been removed and can be, for example, serviced or replaced. The valve body 756 is in the closed position, thus holding any pressure from the well reaching the port 301 and channel 752.

To insert the sensor unit 200 (or a replacement sensor unit), the new sensor unit 200 is attached to the engagement element 764 and the tool 758 is reattached to the valve unit 751.

Next, the steps described above are performed substantially in reverse order, i.e.:

- the valve body 756 is brought to its open position,
- the arm 762 is extended through the valve 751 and into the spool unit 102 such that the threads 201 of the new sensor unit 200 are brought into contact with the corresponding threads of the port 301,
- the arm 762 is brought to rotate such that a fluid-tight, threaded engagement is created between the new sensor unit 200 and the port 301,
- the arm 762 is retracted out of the spool unit 102 and past the valve body 756,
- the valve body 756 is brought to its closed position,
- the tool 758 is detached from the valve unit 751 and the engagement element 764 is substituted for the engagement element 763,
- a plug 400 is attached to the engagement element 763 and the tool 758 is reattached to the valve unit 751,
- the valve body 756 is brought to its open position,
- the arm 762 is inserted through the valve unit 751 and into the spool unit 102 such that the threads 401 of the plug 400 are brought into contact with the threads 110 of the through-channel 101,
- the arm 762 is brought to rotate such that a fluid-tight, threaded engagement is created between the plug 400 and the spool unit 102,
- the arm is retracted out of the spool unit 102,
- the tool 758 is detached from the valve unit 751,
- the valve unit 751 is detached from the spool unit 102, and
- the blind flange 500 is reattached to the spool unit 102.

In certain cases, it may be desirable to remove sensor unit 200 mounted in a wellhead 300 and install a dummy plug 767. This may be advantageous if the port 301 is to be permanently or semi-permanently sealed off, for example while obtaining a replacement sensor unit 200 or at times when use of the port 301 is not required for a temporary period or permanently.

In one embodiment, the method therefore comprises the steps, after having removed a sensor unit 200 from the port 301, of:

- positioning a dummy plug 767 onto the arm 762,
- reattaching the tool 758 to the valve unit 751, inserting the arm 762 and the dummy plug 767 into the spool unit 102, operating the arm 762 to mount the dummy plug 767 inside the port 301, and withdrawing the arm 762 out of the spool unit 102, detaching the tool 758 from the valve unit 751 and positioning a plug 400 onto the arm 762, and reattaching the tool 758 to the valve unit 751, inserting the arm 762 and the plug 400 into the spool unit 102, operating the arm 762 to mount the plug 400 inside the spool unit 102.

Thus, a double barrier between the port 301 and the atmosphere can be obtained.

In certain cases, it may be desirable to be able to install a sensor unit 200 in a port 301 of a wellhead 300, where the port is arranged with a dummy plug 767. According to one embodiment, the method comprises the steps, prior to installing a sensor unit 200, of:

inserting an arm 762 of the tool 758 into the spool unit 102, operating the arm 762 to disengage the plug 400 from the spool unit 102, and withdrawing the arm 762 and the plug 400 out of the spool unit 102;

detaching the tool 758 from the valve unit 751, removing the plug 400 from the arm 762, and reattaching the tool 758 to the valve unit 751;

inserting the arm 762 into the spool unit 102, operating the arm 762 to disengage a dummy plug 767 from the port 301, and withdrawing the arm 762 and the dummy plug 767 out of the spool unit 102.

In one embodiment, the method further comprises the step of arranging a receiver unit 600 on the spool unit 102. This allows installation of, for example, a pressure monitoring system in a port 301 on a wellhead which did not have this capability.

According to embodiments, a safe and reliable port plug assembly is provided, having a double barrier between the well and the atmosphere. In the case of leakage across one of the barriers, for example across the sensor unit 200, components can be replaced without requiring the well to be taken out of production. Pressure testing of the various seals can be carried out between steps in an installation/removal/replacement process as described above or while the port plug assembly is installed and the well is producing, in order to ensure and/or verify the integrity of the seals. In one embodiment, the seal between the tool 758 and the second end 102*b* is pressure tested by increasing a pressure in the channel 752. In one embodiment, the seal between the plug 400 and the through-channel 101 and/or the seal between the sensor unit 200 and the port 301 is pressure tested by increasing the pressure in the through-channel 101. Such pressure testing can be carried out in the conventional manner, by e.g. supplying a compressed gas to the relevant space via appropriate conduits (e.g. conduits 104 and 765).

Embodiments of the present disclosure allow installation of a sensor unit 200 in a port 301 of a wellhead 300 without compromising safety, for example in that a double fluid barrier is maintained during well production and no feed-through of signal or power cables (which may introduce a possible leakage path) is needed, while at the same time allowing the sensor unit 200 to be retrieved and replaced in a safe manner, if required. The integrity of the system can be maintained and the risk of leaks minimised in that pressure testing of seals and connections can be carried out, as required, without the risk of damaging, for example, electronics components of the sensor unit 200 or feed-through arrangements for electric signal or power cables. According to embodiments described herein, a wellhead port plug assembly 100 can additionally, or alternatively, be made more compact and more robust, and/or less prone to failure, for example in that no signal or power cable extending through an end cap and from a back end of a spool unit 102 is required. This reduces the risk of damage from mechanical impacts to the signal and/or power cable and eases the layout and cabling on the wellhead.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising embodiments of this disclosure in diverse forms thereof.

The present disclosure is not limited to the embodiments described herein; reference should be had to the appended claims.

The invention claimed is:

1. A wellhead port plug assembly comprising: a sensor unit comprising a sensor, the sensor unit having first connection elements configured for sealingly and removably mounting of the sensor unit in a port of a wellhead of a hydrocarbon well; a spool unit having a through-channel extending between a first end and a second end of, the spool unit, second connection elements arranged in the through-channel, wherein the through-channel has a first through-channel portion and a second through-channel portion;

a flange, the flange configured for sealingly mounting the spool unit to the wellhead such that the through-channel is aligned with the port;

a plug comprising third connection elements configured for sealingly and removably engaging the second connection elements and fix the plug in the through-channel;

a transmitter unit arranged in the sensor unit and comprising a wireless signal transmitter;

a receiver unit arranged on the spool unit and comprising a wireless signal receiver; and an annular shoulder arranged between the first through-channel portion and the second through-channel portion, wherein the annular shoulder is arranged to co-operate with the plug for providing a metal-to-metal seal between the annular shoulder and the plug.

2. The wellhead port plug assembly according to claim 1, further comprising:

an inductive transducer arranged in the sensor unit, the inductive transducer configured to provide electric power to at least one of the sensor and the wireless signal transmitter; and an inductive generator arranged on the spool unit and configured to energise the inductive transducer.

3. The wellhead port plug assembly according to claim 2, wherein the inductive generator is arranged in the receiver unit.

4. The wellhead port plug assembly according to claim 1, wherein the sensor unit is arranged in the port, the flange is mounted to the wellhead, and the transmitter unit is positioned in the through-channel.

5. The wellhead port plug assembly according to claim 1, further comprising a blind flange removably mounted to the second end to cover an end opening of the through-channel.

6. The wellhead port plug assembly according to claim 1, wherein at least one of the sensor unit and the plug comprises a tool engagement element for co-operation with a placement and removal tool.

7. The wellhead port plug assembly according to claim 1, wherein the spool unit comprises a conduit extending from a side wall of the flange into the through-channel.

8. The wellhead port plug assembly according to claim 1, wherein the first through-channel portion is configured to accommodate a part of the sensor unit and the second through-channel portion is configured to accommodate the plug.

9. The wellhead port plug assembly according to claim 1, wherein the first through-channel portion has a smaller cross section area than the second through-channel portion.

10. The wellhead port plug assembly according to claim 1, wherein a cross section area of the second through-channel portion is sufficiently large to allow the sensor unit to pass therethrough.

11. The wellhead port plug assembly according to claim 1, wherein a sealed, pressure-resistant protective housing contains the transmitter unit.

12. The wellhead port plug assembly according to claim 1, wherein the wireless signal transmitter is positioned within the transmitter unit and contained within the sensor unit.

13. A method for removing or replacing a sensor unit located in a port of a wellhead having a port plug assembly mounted thereon, the port plug assembly comprising: the sensor unit comprising a sensor, the sensor unit having first connection elements configured for sealingly and removably mounting of the sensor unit in the port of the wellhead of a hydrocarbon well; a spool unit having a through-channel extending between a first end and a second end of the spool unit, second connection elements arranged in the through-channel;

a flange, the flange configured for sealingly mounting the spool unit to the wellhead such that the through-channel is aligned with the port;

a plug comprising third connection elements configured for sealingly and removably engaging the second connection elements and fix the plug in the through-channel;

a transmitter unit arranged in the sensor unit and comprising a wireless signal transmitter; and a receiver unit arranged on the spool unit and comprising a wireless signal receiver, the method comprising:

mounting a placement and removal tool and a valve unit to the second end and aligning a channel of the valve unit to the end opening;

inserting an arm of the tool into the spool unit;

operating the arm to disengage the plug from the spool unit;

withdrawing the arm and the plug out of the spool unit;

inserting the arm into the spool unit;

operating the arm to disengage the sensor unit from the port; and withdrawing the arm and the sensor unit out of the spool unit.

14. The method according to claim 13, further comprising:

detaching the tool from the valve unit;

removing the plug from the arm; and reattaching the tool to the valve unit.

15. The method according to claim 13, further comprising pressure testing a seal between the tool and the second end by increasing a pressure in the channel.

16. The method according to claim 13, further comprising:

inserting the arm and a new sensor unit into the spool unit;

operating the arm to mount the new sensor unit inside the port;

inserting the arm and the plug into the spool unit; and operating the arm to mount the plug inside the spool unit.

17. The method according to claim 16, wherein at least one of (i) operating the arm to mount the sensor unit inside the port and/or (ii) operating the arm to mount the plug inside the spool unit further comprises rotating the arm about a longitudinal axis of the tool.

18. The method according to claim 13, further comprising:

positioning a dummy plug onto the arm;

inserting the arm and the dummy plug into the spool unit;

operating the arm to mount the dummy plug inside the port;

inserting the arm and the plug into the spool unit; and operating the arm to mount the plug inside the spool unit.

19. The method according to claim 18, further comprising pressure testing at least one of a seal between the plug and the through-channel and a seal between the sensor unit and the port by increasing a pressure in the through-channel.

20. The method according claim 18, wherein at least one of (i) operating the arm to mount the dummy plug inside the port and/or (ii) operating the arm to mount the plug inside the spool unit further comprises rotating the arm about a longitudinal axis of the tool.

21. The method according to claim 13, wherein at least one of (i) operating the arm to disengage the plug from the spool unit and/or (ii) operating the arm disengage the sensor unit from the spool unit further comprises rotating the arm about a longitudinal axis of the tool.

22. The method according to claim 13, further comprising:

removing a blind flange from the second end; and reattaching the blind flange to the second end.

23. The method according to claim 13, further comprising pressure testing at least one of a seal between the plug and the through-channel and a seal between the sensor unit and the port by increasing a pressure in the through-channel.

24. A method for installing a sensor unit in a port of a wellhead having a port plug assembly mounted thereon, the port plug assembly comprising: the sensor unit comprising a sensor, the sensor unit having first connection elements configured for sealingly and removably mounting of the sensor unit in the port of the wellhead of a hydrocarbon well; a spool unit having a through-channel extending between a first end and a second end of the spool unit, second connection elements arranged in the through-channel;

a flange, the flange configured for sealingly mounting the spool unit to the wellhead such that the through-channel is aligned with the port;

a plug comprising third connection elements configured for sealingly and removably engaging the second connection elements and fix the plug in the through-channel;

a transmitter unit arranged in the sensor unit and comprising a wireless signal transmitter; and a receiver unit arranged on the spool unit and comprising a wireless signal receiver, the method comprising:

mounting a placement and removal tool and a valve unit to the second end and aligning a channel of the valve unit to the end opening;

inserting an arm and the sensor unit into the spool unit and operating the arm to mount the sensor unit inside the port; and inserting the arm and the plug into the spool unit and operating the arm to mount the plug inside the spool unit.

25. The method according to claim 24, further comprising pressure testing a connection between the tool and the second end by increasing a pressure in the channel.

26. The method according to claim 24, further comprising arranging the receiver unit on the spool unit.

27. The method according to claim 24, further comprising:

inserting an arm of the tool into the spool unit;

operating the arm to disengage the plug from the spool unit;

withdrawing the arm and the plug out of the spool unit;

inserting the arm into the spool unit;

operating the arm to disengage a dummy plug from the port; and withdrawing the arm the dummy plug out of the spool unit.

28. The method according to claim 24, further comprising pressure testing at least one of a seal between the plug and the through-channel and a seal between the sensor unit and the port by increasing a pressure in the through-channel.

* * * * *